United States Patent [19]

Gagliardi et al.

[11] 4,279,535

[45] Jul. 21, 1981

[54] MATERIAL AND SYSTEM FOR MINIMIZING EROSION

[75] Inventors: Joseph Gagliardi, Westport, Conn.; Charles A. Lee, Knoxville, Tenn.

[73] Assignee: Mercantile Development, Inc., Westport, Conn.

[21] Appl. No.: 80,302

[22] Filed: Oct. 1, 1979

[51] Int. Cl.[3] ..... E02B 3/04

[52] U.S. Cl. ..... 405/15; 405/32

[58] Field of Search ..... 405/15, 19, 32, 16; 256/12.5, 13; 428/284, 286, 287

[56] References Cited

U.S. PATENT DOCUMENTS

| | | | |
|---|---|---|---|
| 1,849,323 | 3/1932 | Cleveland et al. | 405/19 |
| 3,811,287 | 5/1974 | De Winter | 405/19 |
| 4,002,034 | 1/1977 | Mühring | 405/19 |
| 4,096,701 | 6/1978 | Den Boer | 405/19 |
| 4,135,843 | 1/1979 | Umemoto et al. | 405/19 X |
| 4,181,450 | 1/1980 | Rasen et al. | 405/19 |
| 4,184,788 | 1/1980 | Colle | 405/19 |

*Primary Examiner*—David H. Corbin

[57] ABSTRACT

A silt fence is provided which includes an elongated first strip of material which was a relatively uniform porosity and which is fabricated from filaments of relatively small diameter. The first strip is attached to an elongated second strip of material which is fabricated from yarns in a grid pattern, the yarns being of relatively large diameter relative to the filaments of the first strip of material and having from about 2 to 8 yarns per inch in each direction. The composite strip has a Frazier air permeability of from about 100 to 1000 cubic feet per square foot per minute at ½ inch of water pressure. The material may be provided with a hem in which is disposed a tensioning member.

In use the tensioning member in the hem is attached to posts and the other edge of the material is buried in a trench in the ground.

9 Claims, 7 Drawing Figures

MATERIAL AND SYSTEM FOR MINIMIZING EROSION

The present invention relates generally to a material and a system for minimizing erosion. More particularly, the invention relates to the provision of a material and system for minimizing the transport of silt and the like by the flow of water.

In excavation and grading work such as in the construction of highways, the work often results in unprotected banks of soil. When these banks are subjected to water flow as during a rain storm, the run-off of ground water carries with it substantial amounts of silt, fine soil, stones and the like. This action results in erosion of the banks and, in addition, causes the fine particles to flow along with the water causing contamination of streams, ponds, private property and vegetation. The banks are seeded to produce vegetation which eventually reduces the velocity of water flow to a point where the silt and soil are not transported. However, under present environmental regulations, run-off during the period that it takes to grow vegetation is generally not tolerated.

Various attempts have been made to solve the run-off problem but they have been either exceedingly expensive or not entirely satisfactory or both. The most common method employed is to determine the path of the ground water which carries the silt or soil particles and to lay bales of hay in end to end relation in a line across the water flow path so that the velocity of the water is decreased to a point that the silt and soil particles drop from the water or are strained therefrom. In most cases, the bales are held to the ground by driving stakes through the bale into the ground. The provision of such lines of bales is exceedingly expensive and it is difficult, if not impossible, to maintain them close enough together so that the ground water does not run between the bales, carrying with it the unwanted silt and soil at velocities which will keep it suspended and which at the same time causes erosion in the soil. Also, depending upon weather and other environmental conditions, the effective life of the baled hay is often not long enough to permit the planted vegetation to grow sufficiently to prevent the undesired results before the retarding action of the bales becomes ineffective.

Another method which has been used, involves the use of an elongated fence, e.g. hog fencing, chicken wire, or the like, which is erected across the path of water flow and to which is fastened a screen formed from a plastic fabric which is designed to strain out the solids which are being carried and which at the same time distributes the flow of ground water over a substantial area transversly of the line of flow so as to reduce its velocity and thus its capability to pick up additional solids and silt. To this end, the lower edge of the screen has been buried in the ground to minimize undermining the barrier. However, the expense of the wire fencing and screen arrangement is extremely high and, in addition, a plastic screen which is sufficiently strong to maintain its integrity under the conditions of use, does not have an optimum porosity or uniformity of porosity which is desirable for most satisfactory silt and soil retention. Also, to reduce the cost of installation, the installers attempt to minimize attachment between the plastic screen and the supporting wire fence. This leaves large unsupported areas which are subject to rupture and damage thereby providing paths for rapidly moving ground water with its suspended silt and soil particles.

It is the principal object of this invention to provide a material which has improved characteristics of strength and porosity; and which can be readily installed. It is also an object of the invention to provide a system for using the material including the matter of fabricating it so that it can be readily installed and so that its effectiveness in impeding the flow of ground water so as to minimize the run-off of silt and soil.

It is a further object of this invention to provide a system and method for impeding the flow of ground water and removing the silt therefrom in such a manner that the run-off and silt and soil is minimized.

Other objects and advantages of the invention will become known by reference to the following description and the appended drawings in which.

Figure 1:
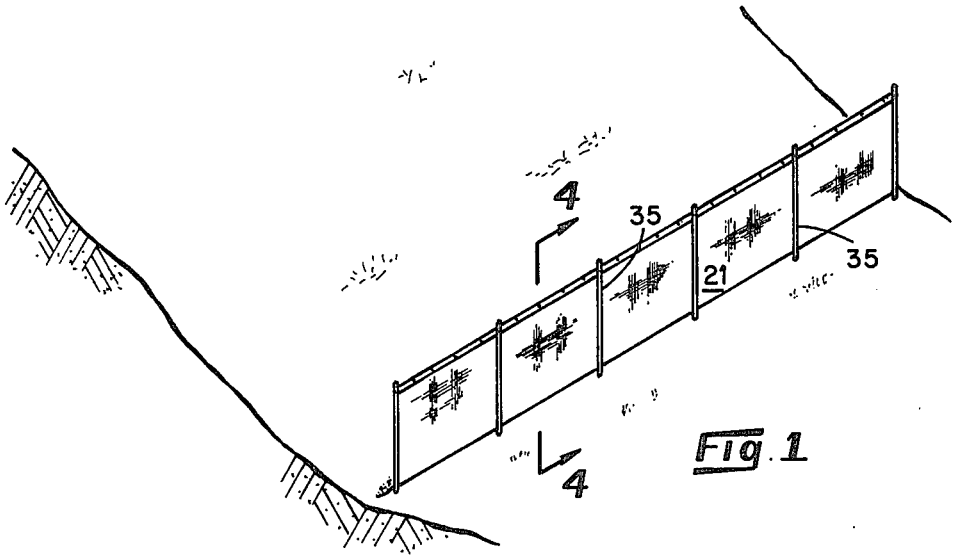
FIG. 1 is a schematic, perspective view of a silt fence, embodying various of the features of the invention, installed on a hillside.

As is shown in the drawings and as will hereinafter be described, one feature of the invention is the provision of a fabric which has the special characteristics of strength and porosity to minimize the flow of silt and the like suspended in ground water while having the requisite strength to resist abrasion and tearing occasioned by the conditions in the field. In general, such a fabric comprises a lamination of one or more webs of a relatively fragile nonwoven fabric of relatively uniform porosity and formed from filaments of relatively small cross-section to a web formed from filaments arranged in a grid pattern, these latter filaments being of relatively larger cross-section relative to the cross-section of filaments of the nonwoven material. Preferably, the filaments of both layers are fabricated from materials which do not readily deteriorate. It has been found that the composite laminated strip should have a Frazier Air Permeability of from about 100 to 1000 cubic feet per minute per square foot at a pressure of $\frac{1}{2}$ inch of water. The choice of a particular permeability within the above range is based upon the characteristics of the suspended materials to be retained and the volume of water flow to be controlled. A Frazier permeability at the lower end of the range should be employed if the suspended material to be retained is exceedingly fine. On the other hand, if the flow rate can be higher and the problem of retention is not so stringent, one can use a fabric having a higher Frazier permeability. In general, it has been found that a Frazier permeability of about 175 to 400 cubic feet per minute per square foot at a pressure of $\frac{1}{2}$ inch of water provides excellent results under most conditions.

The laminated material can be fabricated in such a manner that the material is easily installed at the site. To this end, one edge of the fabric is buried in a trench in the ground and the other edge is supported above the ground in a fence-like configuration on a series of posts or stakes which are driven or otherwise secured in the ground. In order to facilitate the attachment of the second edge of material to the post, one edge of the strip of laminated material is folded over to form a hem which is securely stitched to provide a longitudinally extending pocket.

In order to provide additional strength and to permit optimum installation, a reinforcing member such as cord, cable or the like, is disposed in the pocket formed by the hem to provide means for readily supporting the upper edge of the fabric in a taut condition. It has also been found desirable to provide spaced apart physical bonds between the layers of material under the reinforcing member at spaced apart points on the hem. Thus, in the event that there is a tear or other break in the fabric, the attachment will prevent or minimize the extension of the break into other sections of the fabric. Also, these attachments, if they are in the form of grommets or the like, may be employed to permit the tying of the fabric-fence to the post.

Figure 2:
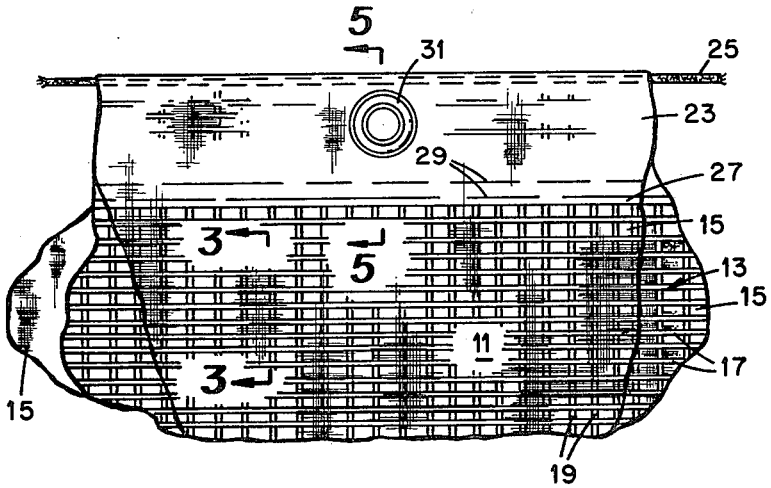
FIG. 2 is a fragmentary view showing a fabric for silt fencing embodying various features of the invention and one mode of fabricating that fabric into a silt fence.
Figure 3:
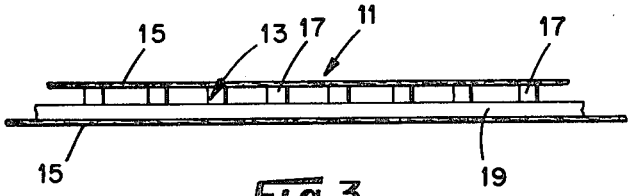
FIG. 3 is a schematic sectional view taken on line 3—3 in FIG. 2.

In the following paragraphs, the embodiment of the invention, as shown in the drawings, will be described more specifically. As shown in FIGS. 2 and 3 the fabric 11 for the silt fence includes a supporting web or layer 13 and at least one filter web or layer 15. The supporting layer 13 is fabricated in the form of a grid or screen formed by warp and weft yarns 17 and 19 which are preferably woven with a plain weave. The grid should include between about two and about eight yarns per inch in each direction. The yarns 17 and 19 in each direction in each inch, should in the aggregate, include over about 3,000 denier and it has been found satisfactory to employ an aggregate of about 3,000 to 7,000 denier per lineal inch in each direction. The regularity of the weave is not of substantial importance, however, the provision of about two to about eight yarns per inch in each direction provides an adequate space between the yarns to permit adequate filtering action of the filtering layer or layers 15 and adequate strength.

The yarns 17 and 19 which make up the supporting layer 13 may be fabricated from any suitable material which does not readily deteriorate on exposure to the elements. For example, the supporting layer yarns 17 and 19 may be nylon, polyester, rayon, glass, or the like. The yarns 17 and 19 may be either monofilament or multifilament.

The filter layer 15 is fabricated from light weight filaments. It has been found that each of the filaments in the web should be less than 5 denier and preferably less than 3 denier. The web should preferably be a nonwoven web of relatively uniform porosity. It is fabricated by water laying, air laying or spun bonding the filaments. The filaments of the filter layer 15 may be fabricated from any material which does not readily deteriorate and exposure to the elements, e.g. nylon, polyester, rayon, glass, or the like. It has been found preferable to employ nylon fibers in the filter layer 15 since nylon nonwoven webs, or polyester, exhibit a more uniform porosity than the usual webs made from other materials. The filter layer or layers 15, to provide the requisite permeability in the final product should aggregate between about 0.75 to 1.5 ounces per square yard. The filter layer 15 can be applied as a single layer on one side of the supporting layer 13 or, as illustrated in FIGS. 2 and 3, it can be in two layers, placed on opposite sides of the supporting layer 13. In the latter event, the weight of each filter web 15 should be between about 0.20 and 0.75 ounce. As will be pointed out, there are substantial advantages in applying the web in two layers, each layer on an opposed side of the supporting layer 13 in that the ultimate silt fence filter is more readily installed and the fabric provides somewhat better filtering action.

The supporting layer 13 and the filter layer or layers 15 may be laminated together in any known manner, however, it is preferable that there be a good interconnection between the filter layer or layers and the supporting layer over substantially the entire area. To this end, the yarns 17 and 19 of the supporting layer 13 are preferably coated with a thermo-plastic binder such as a thermo-plastic resin, latex or the like, and thereafter the webs to be laminated are passed through a roll nip which is heated to bond the two layers together. When a nylon filter web is attached to a polyester supporting web, it has been found that a good bond is obtained by first dipping the supporting layer 13 into an aqueous emulsion of modified polyvinyl chloride which includes an ultraviolet stabilizer to prolong its resistance to sunlight. The emulsion is then dried on the yarns 17 and 19 and the supporting layer 13 and the filter layer or layers 15 to be laminated are passed through a nip comprised of a chrome roll and a hard rubber roll at a temperature at about 250°-375° F. with a nip pressure of approximately 100 lbs. per inch. The heat causes the polyvinyl chloride resin to soften and effect a bond and the heat and pressure causes the yarns and cross overs in the supporting layer 13 to be flattened so as to increase the surface area of the yarns available for bonding and to provide a smooth surface to the final product rather than an irregular surface as would be caused by a lesser pressure.

Good results have also been obtained by using a latex emulsion following the procedures outlined above.

SPECIFIC EXAMPLE

Fabric for a silt fence was made as follows:

The supporting layer 13 was fabricated from 1,000 denier polyester yarn having five yarns per inch in each direction. The yarns were woven with a plain weave.

The weave yarn supporting layer was dipped into an aqueous emulsion of modified polyvinyl chloride which includes an ultraviolet stabilizer to provide a pick-up of from about 150–200 percent of solids based upon the weight of the supporting layer yarns. The supporting layer 13 was then dried by passing it over teflon coated rolls heated to a temperature of about 215° F.

Two filter layers 15 were employed, one on each side of the support layer 13, each filter layer was spun bonded nylon sold by Monsanto Corporation under the trademark "CEREX" and having a weight of about 0.5 ounce per square yard. The individual filaments were approximately 1.5 denier.

The three webs, the support layer 13 with a filter layer 15 on each side was passed through a set of rolls comprising a chrome plated roll and a hard rubber roll under a pressure of 100 lbs. per lineal inch in the nip. The chrome roll was heated to a temperature of 350° to 365° F. The passage through the roll reduced the thickness of the laminated material from 30 mills to approximately 10 mills which resulted in a substantial flattening of the warp and weft yarns 17 and 19 and of the cross-overs.

The bonded composite material weighed 4.0 ounces per square yard and had a Mullen burst test, as determined by ASTM Test D774–46 of approximately 217 lbs. In accordance with ASTM Test D1682, the elongation to break was approximately 40 percent. The trapezoidal tear as determined by ASTM Test D2263 was approximately 33 lbs. The breaking load as determined by ASTM Test D1682 (grab method) averaged about 130 pounds in each direction. The Frazier Air Permeability of the laminated sheet was approximately in the range of 200–287 cubic feet per minute per square foot (average: 245 cubic feet per minute per square foot) under ½ inch of water pressure. The water permeability was above 450 gallons per minute per square foot under a five inch head of water. The equivalent opening size, as determined by the U.S. Corp. of Engineers Guide Specification CW02215 of November, 1977, was 70–100.

When installed as a silt fence in the manner to be described, this material was found to resist field conditions such as falling rocks, abrasion, large volume water flow and build up of silt in banks as high as about 2–3 feet. It adequately distributed ground water and removed the required amounts of silt from the ground water under most soil conditions.

Figure 5:
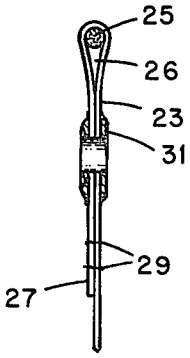
FIG. 5 is a sectional view taken on line 5—5 in FIG. 2.

In fabricating a silt fence 21 from a fabric of the type described, one edge of the fabric is turned over to provide a hem 23 approximately 1½ inches in width (FIGS. 2 and 5). A reinforcing strand 25 is disposed in pocket 26 in the hem 23, e.g. a ⅛ inch braided nylon cord, and the marginal edge 27 of the turned over portion is attached to the body of the sheet with a seam 29. The attachment can be effected by any suitable manner. For example, the seam may be made by an adhesive, by heat sealing or by sewing. It has been found that an adequate seam 29 may be made by sewing with thread of adequate strength.

In order to prevent a failure of the seam in the hem 23 from destroying or interfering with the operation of the fence 21, the layers of material in the hem area are interconnected at spaced intervals to provide stops for tearing or like in the event that the seam 29 of the hem fails. This can be accomplished by employing spaced apart spots of adhesive, heat seals or the like, the position of the seals being such that the integrity of the pocket 26 for the reinforcing and tensioning strand 25 is insured. The preferred method of spaced apart attachment in the hem area involves the use of metal grommets 31 which are inserted in the hem at suitable intervals, e.g. approximately three feet apart, with the reinforcing strand 25 retained in the pocket 26 between the grommets 31 and the folded over portion of the hem. The grommmets 31 also provide openings to receive attaching cords or clips in addition to interconnecting the material in the hem or to provide a supplementary seal.

Figure 4:
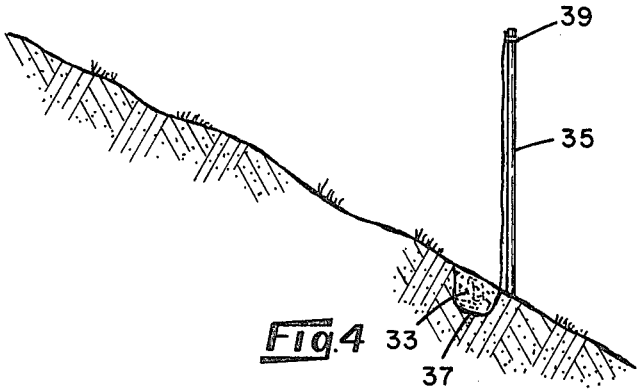
FIG. 4 is a sectional view taken on line 4—4 in FIG. 1.

In installing the silt fence 21 on a site, e.g. as shown in FIG. 1, a trench 33 approximately 4–6 inches deep and 6 inches wide is dug in the soil following the path in which the silt fence 21 is to be disposed (FIG. 4). Next to the trench, on the down slope of the hill, a series of posts or stakes 35 are driven at appropriate intervals (e.g. six to ten feet apart), the stakes 35 being disposed generally vertically and preferably making an acute angle with the surface of the ground upstream of the trench, but in any event being slightly angled from the vertical towards the anticipated flow of water. This lessens the stresses applied to the fence by the water and entrained materials.

Figure 6:
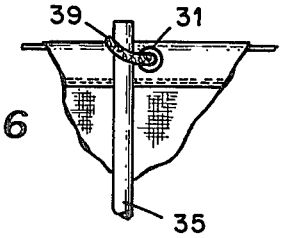
FIG. 6 is a fragmentary view showing one means of attaching the silt fence shown in FIG. 2 to a supporting post.
Figure 7:
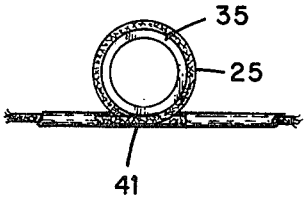
FIG. 7 is a plan view of another manner of attaching a silt fence shown in FIG. 2 to a supporting post.

The edge of the fabric opposite the hem 23 is placed in the trench with its marginal edge 37 directed upstream from the line of stakes 35 (FIG. 4). The earth obtained from the trench 33 is then replaced in the trench over the fabric in the trench to anchor it in the ground and to provide a stop for water between the ground and the lower portion of the fabric. The hem edge of the fence is then attached to the stakes 35 by employing cord or clamps 39 through the grommets 31 and around the stakes (FIG. 6). In the event that a stake is not adjacent a grommet, the rolled over portion of the hem 23 may be cut as at 41 in FIG. 7 and a portion of the reinforcing strand 25 is then pulled from the hem and disposed around and tied to the stake 35. The hem edge of the fabric is maintained taut between the posts employing the cord and the reinforced hem portion of the fabric.

In use, it has been found that the fence, as described above, spreads any ground water flowing on the slope laterally and releases it over a substantial lateral area so as to reduce the flow rate to minimize erosion on the down stream side of the fence. Also, the filtering action of the nonwoven layer or layers causes the silt and other fine particles, as well as rocks and the like, to be maintained on the upstream side of the fence. While the mechanism is not thoroughly understood, it is believed that the relatively smooth surface resulting from the facing of nonwoven material forms a flow pattern which causes the silt particles to agglomerate and form larger particles which are more easily retained. To this end, if a fence is fabricated with only one layer of nonwoven filtering material it has been found that the material should be maintained on the upstream side of the supporting layer to enhance this effect.

It is also believed that more effective filtering action is obtained when the filter layer is applied in two layers, one of each side of the supporting layer, because of the spacing between the two layers. This construction seems to enhance filtering action and minimizes blockage.

Various of the features of the invention which are believed to be new are set forth in the appended claims.

What is claimed is:

1. A material for use as a silt fence, one marginal edge of which is adapted to be buried into the ground and the other marginal on which is adapted to be supported by uprights or the like, above the ground comprising an elongated first strip of material having a relatively uniform porosity which strip of material is fabricated from filaments of less than about 5 denier, an elongated second strip of material fabricated from yarns in a grid pattern, such yarns being in the aggregate of about 3,000 to 7,000 denier per linear inch in each direction and having from 2 to about 8 yarns per inch in each direction, said first and second strips being fabricated from material which does not readily deteriorate, and said first and second strips being attached together to provide a composite strip, the composite strip having a Frazier air permeability of 100 to 1,000 cubic feet per square foot at a pressure of ½ inch or water.

2. The material of claim 1 in which said first and second strips are attached together by a thermo-plastic binder over a substantial portion of the overlapping areas.

3. The material of claim 1 in which one marginal edge is folded over to provide a hem, the edge being attached to the body of the sheet to provide an elongated pocket running along that side of the sheet and an elongated flexible tensioning member disposed in said pocket.

4. The material of claim 3 in which a plurality of spaced apart attachments are provided in the hem inwardly of the outermost portion of the fold, the tensioning member being disposed between said plurality of attachments are provided in the hem inwardly of the outermost portion of the fold, the tensioning member being disposed between said plurality of attachment members and the tensioning member to maintain the tensioning member in the fold of the hem.

5. The material of claim 2 in which the Frazier air permeability is from 175 to 400 cubic feet per square foot per minute at a pressure of one half inch of water, and the material of said first strip is fabricated from filaments of less than about 3 denier.

6. The material of claim 5 in which the yarns in said second strip of material have flattened surfaces in contact with said first strip of material.

7. A system for retarding the flow of silt and the like along the ground in ground water comprising trench generally transverse to the anticipated line of ground water flow, providing supporting posts in the ground at spaced intervals on the downstream side of said trench, a composite strip of material disposed along said line of posts, said material comprising an elongated first strip of material having a relatively uniform porosity which strip of material is fabricated from filaments of relatively small diameter, an elongated second strip of material fabricated from filaments in a grid pattern, such filaments being of relatively large diameter relative to the filaments into said first strip of material and having from two to about eight filaments per inch in each direction, said first and second strips being fabricated from material which does not readily deteriorate, and said first and second strips being attached together to provide said composite strip, said composite strip having a Frazier air permeability of 100 to 1000 cubic feet per square foot at a pressure of ½ inch of water, one marginal edge of said material being folded over to provide a hem, the edge being attached to the body of the sheet to provide an elongated pocket running along that edge of the sheet and an elongated flexible tensioning member disposed in said pocket, means attaching the longitudinal tensioning member to said ports above the ground level, the other marginal edge of said material being disposed in said trench, said trench backfilled on top of said last mentioned marginal edge to anchor that edge in the ground, and the first strip of material being disposed on the upstream side of said composite strip of material.

8. The system of claim 7 in which said second strip of material is interposed between two first strips of material and said composite strip of material has a Frazier air permeability of from 175 to 400 cubic feet per square foot at a pressure of ½ inch of water.

9. A material for use as a silt fence, one marginal edge of which is adapted to be buried into the ground and the other marginal edge of which is adapted to be supported by uprights or the like, above the ground comprising two elongated first strips of material, each first strip having a relatively uniform porosity and being fabricated from filaments of less than about 5 denier, an elongated second strip of material fabricated from yarns in a grid pattern, such yarns being in the aggregate of about 3,000 to 7,000 denier per linear inch in each direction and having from 2 to about 8 yarns per inch in each direction, said first and second strips being fabricated from material which does not readily deteriorate, and one of said first strips being disposed on one side of said second strip and the other of said first strips being disposed on the other side of said second strip and being attached to said second strip to provide a composite strip, the composite strip having a Frazier air permeability of from 100 to 1,000 cubic feet per square foot at a pressure of one half inch of water.

* * * * *

UNITED STATES PATENT OFFICE

CERTIFICATE OF CORRECTION

Patent No. 4,279,535 Dated July 21, 1981

Inventor(s) Joseph Gagliardi and Charles A. Lee

It is certified that error appears in the above-identified patent and that said Letters Patent are hereby corrected as shown below:

Column 4, line 46, "weave" should be -- woven --.

Column 8, line 9, after "trench" (second occurrence) insert -- being --.

Signed and Sealed this

Twenty-second Day of September 1981

[SEAL]

Attest:

GERALD J. MOSSINGHOFF

Attesting Officer

Commissioner of Patents and Trademarks